United States Patent [19]

Booth

[11] 4,411,557

[45] Oct. 25, 1983

[54] METHOD OF MAKING A HIGH-CAPACITY EARTHBOUND STRUCTURAL REFERENCE

[76] Inventor: Weldon S. Booth, 750 Rte. 9W, Piermont, N.Y. 10968

[21] Appl. No.: 208,773

[22] Filed: Nov. 20, 1980

Related U.S. Application Data

[63] Continuation of Ser. No. 959,903, Nov. 13, 1978, abandoned, which is a continuation of Ser. No. 783,316, Mar. 31, 1977, abandoned.

[51] Int. Cl.[3] ..... E02D 5/44

[52] U.S. Cl. ..... 405/238; 405/239; 405/262

[58] Field of Search ..... 405/232, 233, 237, 238, 405/239, 256, 260, 262

[56] References Cited

U.S. PATENT DOCUMENTS

| | | | |
|---|---|---|---|
| 890,765 | 6/1908 | Gilbreth | 405/237 |
| 987,266 | 3/1911 | Smith | 405/196 X |
| 1,888,282 | 11/1932 | Miller | 405/238 |
| 2,027,511 | 1/1936 | Bertran | 405/239 |
| 3,191,390 | 6/1965 | Schutte | 405/238 |
| 3,745,776 | 7/1973 | Hubby | 405/222 |
| 3,952,818 | 4/1976 | Jasper | 405/257 X |
| 4,069,677 | 1/1978 | Yamada et al. | 405/262 X |

FOREIGN PATENT DOCUMENTS

| | | |
|---|---|---|
| 535449 | 10/1931 | Fed. Rep. of Germany . |
| 1238773 | 7/1960 | France . |

*Primary Examiner*—David H. Corbin

*Attorney, Agent, or Firm*—Hopgood, Calimafde, Kalil, Blaustein & Judlowe

[57] ABSTRACT

The invention contemplates an earth-anchor or the like structural reference which is cast in cementatious filling at the installation site and which relies upon a particularly characterized bored cavity in the underground medium to permit primary reliance upon the confined compressive strength of the medium, thereby substantially increasing the load capacity of the reference, as compared to prior constructions. To achieve this result, the bored cavity is characterized by one or more wall surfaces of relatively uniform slope with respect to the axis of the bore, the slope being dependent upon the particular medium. The invention is described in application to a foundation pile or caisson, and to an earth anchor, to illustrate compressional and tensional uses.

10 Claims, 11 Drawing Figures

METHOD OF MAKING A HIGH-CAPACITY EARTHBOUND STRUCTURAL REFERENCE

This is a continuation of copending application Ser. No. 959,903, filed Nov. 13, 1978, abandoned which in turn is a continuation of application Ser. No. 783,316, filed Mar. 31, 1977, now abandoned.

This invention relates generally to the construction of large buildings and other structures which must rely upon a secure earthbound reference. The expression "earthbound reference" shall be understood to apply to any of the well understood structural forms including caissons, piles, piers and anchors and shall be understood to contemplate their embedment in various soil materials, including solid rock, decomposed and soft rocks, and earth materials such as clays and granular soils.

In constructing large buildings, the primary columns of the building must have secure footing in the underground or subgrade medium. Generally, piles are brought to the site and are driven into the medium, or cylindrical borings are made and filled with concrete. Both these techniques provide upright structure embedded in the medium and their load-bearing capacity is determined essentially by the cross-sectional area of the pile or caisson involved, although in some cases a degree of vertical load is sustained by the shear strength of vertical wall-surface interfacing with the medium. The larger the sectional area, the greater the direct load-bearing capacity; and, with accompanying larger interface area, the shear component of load capacity will also be enhanced. Importantly, however, for example in a cylindrical construction, the load-bearing capacity is primarily a function of the diameter of the pile or caisson structure itself, namely, the bottom or cross-sectional area, and the vertical wall-surface area involved in the shear component.

It is an object to provide an improved earthbound structural reference of the character indicated, and a method and means of making the same.

Another object is to meet the above-stated object with a construction and technique requiring less structural material for a given-capacity earthbound reference.

A further object is to meet the above objects with a technique whereby important and materially increased reliance may be placed upon the confined compressive strength of the underground medium, to an extent rendering the effective sectional area of the structure substantially greater than its actual sectional area.

It is also an object to achieve the above objects with a minimum reliance upon prefabricated structural component parts.

It is a general object to provide a better and more efficient earthbound structural reference, at less cost, and involving a lesser volume of excavation, for a given load capacity.

Other objects and various further features of novelty and invention will be pointed out or will occur to those skilled in the art from a reading of the following specification in conjunction with the accompanying drawings. In said drawings, which show, for illustrative purposes only, preferred embodiments of the invention:

Figure 1:
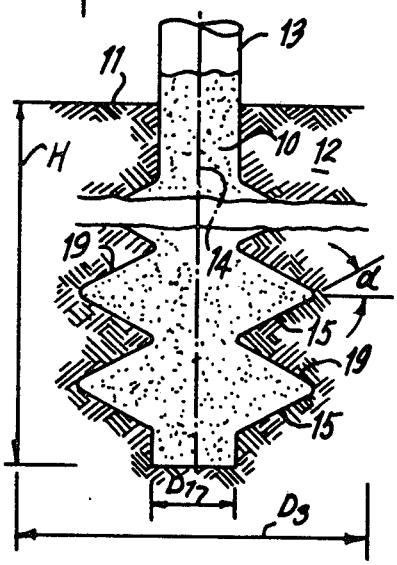
FIG. 1 is a simplified and partly broken-away vertical sectional view of an installed pile or caisson structure of the invention.

In FIG. 1, the invention is shown in application to a vertical pile, pier, or caisson 10 which is vertically embedded to the extent H below level 11 in an underground medium 12, which may be earth, clay, shale or whatever else the nature of the subsoil at the site of pile 10. The pile 10 is of cementatious material such as concrete, cast at the site and, if desired, integral with an upstanding column portion 13. A heavy phantom line 14 will be understood to designate central reinforcement of the pile and column 10–13, for example, with one or more reinforcing or structural members, as appropriate for the load requirements of the installation. It is of particular importance to the invention that at least the more deeply embedded region of pier 10 is characterized by plural spaced inclined surfaces 15 which present an essentially uniform aspect to the medium 12, so as to make substantial use of the confined compressive strength of medium 12 in terms of effective load-bearing support for column 13, as will later become more clear.

Figure 2:
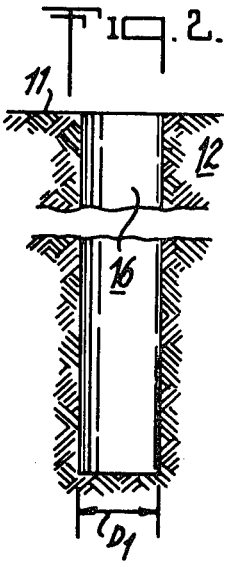
FIGS. 2 and 3 are similar sectional views to illustrate steps in constructing the installation of FIG. 1.
Figure 3:
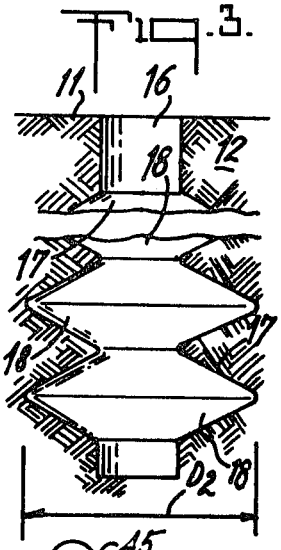

The combined pile and column 10–13 of FIG. 1 is generally cylindrical, about a central axis, with a minimum diameter $D_1$ (which may also be substantially the diameter of column 10) and a maximum diameter $D_2$ (FIG. 3) which may be several times the diameter $D_1$. Construction proceeds by first making a straight cylindrical bore of diameter $D_1$ to the desired overall extent H, as shown in FIG. 2, and by then locally expanding and characterizing the bore 16 with spaced frusto-conical formations 17–18 to the maximum diameter $D_2$, as shown in FIG. 3. The reinforcing means 14 is then erected and positioned as desired, and concrete and/or grout is poured or otherwise introduced to fill the mold cavity, it being understood that, if desired, above grade level 11 an expandable tubular mold form (not shown) is used to permit integral formation of pile 10 with column 13.

For the compression load-bearing pile or column 10 of FIG. 1, it is the downwardly facing inclined surfaces 15 which directly contribute, i.e., which have load-sustaining interface with the medium 12. Generally speaking, the preferred slope $\alpha$ of such surfaces will depend upon the nature of the medium, and I prefer that the slope of the upwardly facing inclined surfaces 19 shall be equal and opposite to that of surfaces 15, thus providing substantial pile body mass through which to distribute load via the surfaces 15. Generally, the included angle ($2\alpha$) between adjacent slopes 15–19 is in the range of 90°±45°, the lesser angles being more suited to a rocky medium 12 and the greater angles being more suited to soil medium 12; in fact, this included angle for some soils may be as high as 175°.

Figure 4:
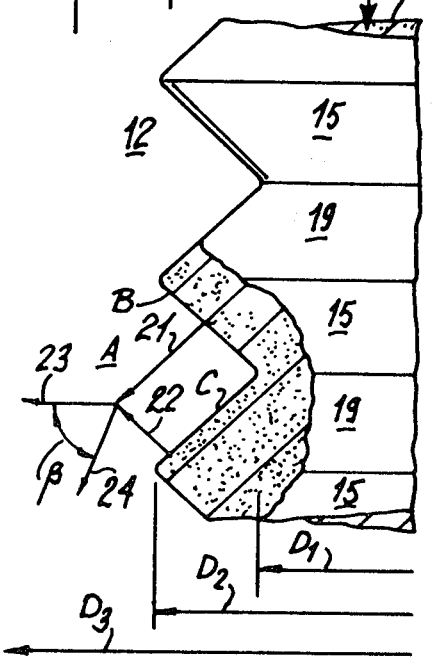
FIG. 4 is an enlarged fragmentary diagram, partly broken-away and in vertical section, to enable discussion of principles of the invention.

While the exact mechanical rationale for the efficacy of my invention is not fully understood, it is believed that FIG. 4 will aid in at least in an appreciation of its qualitative aspects. In FIG. 4, a localized fragment of the pile 10 has been broken-away and shown in vertical section, to enable discussion of forces and force components, particularly insofar as the localized region A between the direct load-sustaining surface B and the indirect load-sustaining surface C are concerned. The direct building load on pile 10 is symbolized by a central arrow 20, and at region A, the direct-load component 21 and the indirect-load component 22 react with an angular spread $\beta$ of distributed force, suggested by and between generally radial and generally downward limits 23–24. The force designation 21 may be taken as the sum total of force contributions along surface B at the plane of the section, and a similar view of designation 22 may be taken as to the total of indirect contributions of force reaction by surface C. The horizontal limit 23, in the context of an outer imaginary cylinder 25 of diameter $D_3$, applies because elevation of the vector 23 above the horizontal signifies an inability to provide a vertical component of support within cylinder 25. However, to the extent that the medium 12 is capable of sustaining confined compressional force (specifically, radially directed force suggested at 23), the surfaces B and C will have contributed to provide an effective horizontal sectional support area reflecting substantially the diameter $D_3$, being a much greater area than is implied by either of the diameters $D_1$–$D_2$ which characterize the pile 10.

To state matters in other words, the pile 10 may be relied upon to do the load-sustaining job of a much larger cylindrical pile, e.g., of diameter approaching $D_3$, primarily because the inclined surfaces 15 and 19 coact with the medium 12 in its state of confined compressional stress, so that the medium 12 in the annulus between pile 10 and the imaginary cylinder 25 is effectively an integral component of the pile itself. If will of course be understood that the region beneath pile 10 provides direct load-sustaining support for not only the area described by diameters $D_1$ and $D_2$ but also for the area described by diameter $D_3$, in that cylinder 25 by definition comprehends the region of confined compressional stress of medium 12.

Figure 5:
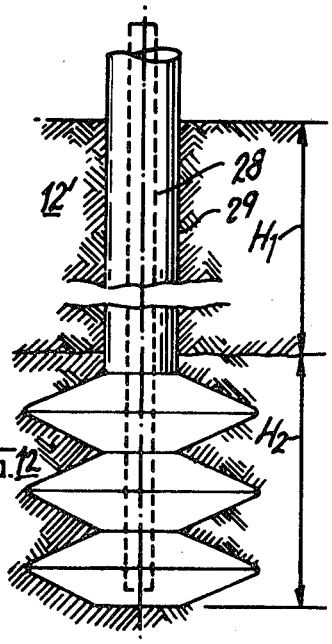
FIG. 5 is a similar vertical sectional view to illustrate a modified installation.

FIG. 5 illustrates application of the invention to a situation in which the local upper stratum 12', to a depth $H_1$, is inadequate to the specified foundation task so that reliance must be placed upon a more substantial lower stratum 12''. In this situation, a casing 27, if required, assures clean access to the lower stratum 12'' for boring operations as described in connection with FIGS. 1 and 2, the lower penetration being shown to the additional depth $H_2$. A more substantial reinforcement member 28, such as a steel column of H-section is shown placed in the characterized bore for embedment in the molded casting which results from filling with cementatious material, as described in connection with FIG. 1.

Figure 6:
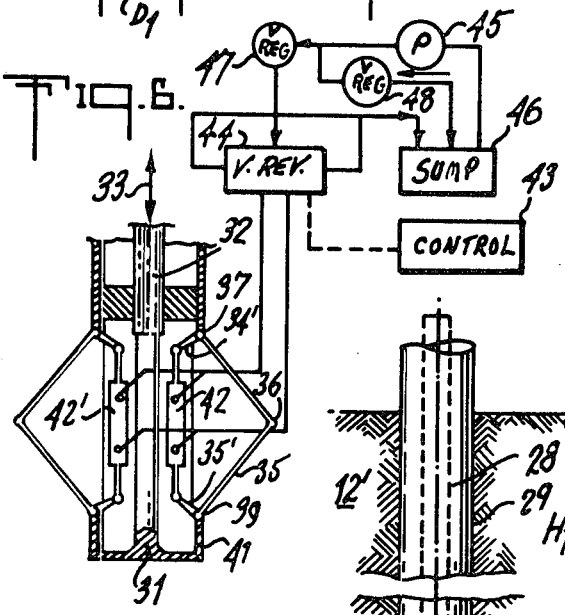
FIG. 6 is a simplified diagrammatic vertical sectional view through a tool element used in constructing the installations of FIGS. 1 and 4.
Figure 7:
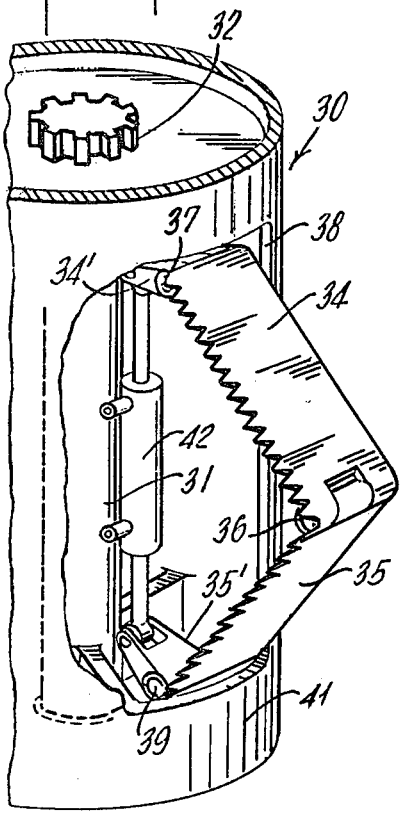
FIG. 7 is an enlarged fragmentary and partly broken-away perspective view of part of the tool element of FIG. 5.

FIGS. 6 and 7 are simplified diagrams to illustrate a boring-tool element suitable for rotational drive by means not shown, to form slope-characterized surfaces 17–18, referred to in connection with FIG. 3. The tool element of FIGS. 6 and 7 comprises an outer tubular body member 30 and an inner tubular member 31 concentrically guided for reciprocation within member 30, a splined or keyed relationship being shown at 32 between these members. The outer member 30 will be understood to be formed at its upper end for connection to rotary drilling mechanism, and double arrows 33 are suggestive of the controlled axial reciprocation that may be imparted to inner element 31 with respect to outer element 30, in the course of continuous rotation of the tool. Angularly spaced pairs of articulated cutter elements 34–35 are pivotally connected to each other at 36, the upper end of cutter 34 being pivotally connected at 37 to side walls of one of a plurality of downwardly open slots 38 in outer element 30, and the lower end of cutter 35 being pivotally connected at 39 to side walls of one of a corresponding plurality of upwardly open slots 40 in the cupped lower projecting end 41 of member 31. Each cutter element 34 (35) is shown as a bell crank, with an inwardly projecting actuating arm 34' (35'). Actuation is by way of double-acting hydraulic-cylinder means 42, one end of which (e.g., the piston-rod end) is connected to upper-cutter arm 34' and the other end of which (e.g., the cylinder-head end) is connected to lower-cutter arm 35'.

In FIG. 6, schematic illustration is provided for hydraulic control of cylinder 42, using means 43 to suitably position the movable member of reversing-valve means 44. The two outlets of valve means 44 are connected to serve the head and tail ends of cylinder 42, as well as all other corresponding cylinders 42' serving other pairs of cutter elements. Hydraulic fluid is drawn by pump 45 from a sump 46, and is supplied via regulating-valve means 47 to the valve means 44, the flow being returned to sump 46 by way of relief-valve means 48 to the extent it is not needed for operation of cylinders 42–42'. In a neutral position of control 43, no flow is required to cylinders 42—42', and so all flow is returned via means 48 to sump 46. On the other hand, for one shift direction determined by means 43, valve 44 directs flow to the tail ends of cylinders 42—42' (with return flow via the head ends of cylinders 42—42' and means 44 to sump 46); in this circumstance, cutter elements 34–35 are driven outwardly, as to the positions shown in FIGS. 6 and 7, so that their serrated cutting edges may generate a frusto-conical cut in medium 12 during the indicated continuous rotation of the tool (clockwise, in the sense of FIG. 7). For the other shift direction determined by means 43, valve 44 directs flow to the head ends of cylinders 42—42' (with return flow via the tail ends of cylinders 42—42' and means 44 to sump 46); in this circumstance, cutter elements 34–35 are driven inwardly to the extent of full retraction, i.e., to the point of inclusion within the outer cylindrically projected area of outer member 30. In the course of the indicated cutter-element actuation, tool rotation is continuous, and the splined fit at 32 enables the lower end 41 of member 31 to rise and fall as indicated by the described articulation of elements 34–35.

Figure 8:
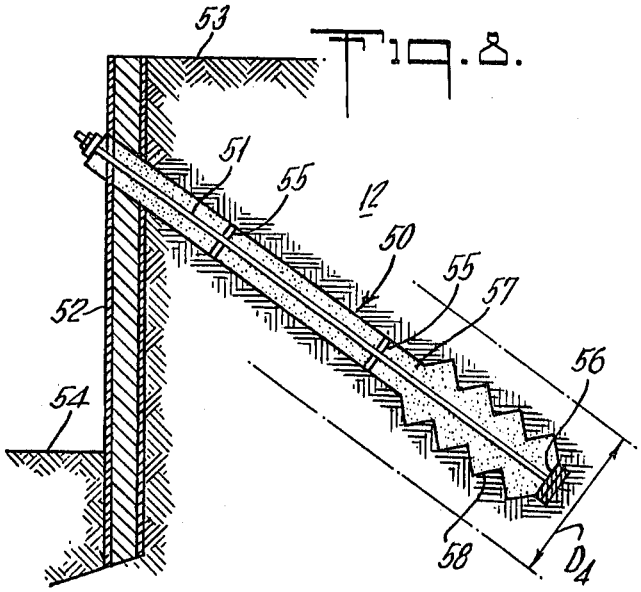
FIG. 8 is a vertical sectional view to illustrate an earth-anchor employment of the invention.

FIG. 8 is illustrative of the employment of principles of the invention to an earth anchor 50 having a central tension member 51, bolted or clamped at its exposed end to retain a rock face or an earth-support system such as sheet-piling or soldier-beam means 52 which lines a side wall of an excavation from a level 53 to a subgrade level 54. The anchor 50 is made substantially in accordance with the technique described in connection with FIGS. 1 to 3, with provision of plural pairs of oppositely sloped frusto-conical enlargements of the bore near the base end of the anchor—all on an inclined axis as desired for anchorage. In view of the inclination of the anchor axis, spider or the like spacers 55 at appropriate axial spacings preserve the substantially straight and central positioning of member 51 with respect to the anchor axis, and a plate 56 welded or otherwise secured to the base end of member 51 assures full compression of the cementatious casting 57 when the member 51 is fully tensed to retain wall 52. It will be appreciated that with the conically sloped projections 58, provided in plurality, slope and diametral extent appropriate to the medium 12, the net retaining capacity of the resulting anchor is importantly a function of the confined compressive strength of medium 12, as to an effective diameter $D_4$ analogous to that discussed at $D_3$ in connection with FIG. 4, the only difference being that the primary load-sustaining conical surfaces are (in FIG. 8) those which face toward the bolted end of member 51.

Figure 9:
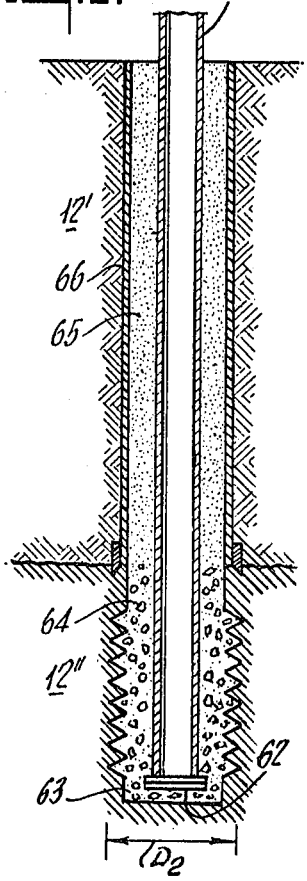
FIG. 9 is a vertical sectional view to illustrate a modified caisson.

FIG. 9 illustrates application of the invention to the construction of a caisson wherein a structural column 60 derives footing support from a lower stratum 12'' which may be of rock, well beneath a soil covering 12'. As with FIG. 5, the lower stratum 12'' relied upon for enhanced support through confined compressional stress is bored with circumferential ridge formations 61, which provide downwardly facing, outwardly inclined load-bearing surfaces. A flat plate 62 is "tacked" as by spot welds to the lower end of column 60, and undue stress concentrations in the vertically downward distribution of load are reduced by placing a relatively small initial charge 63 of sand or grout over the bottom of the bore in the hard stratum 12''. Thereafter, and with column 60 suitably positioned, the cementatious fill at the ribbed region, i.e., for the remaining volume 64 of the bore in stratum 12'', is preferably concrete; concrete or grout may then be applied under pressure (e.g., up to about 300 psi) to fill the remaining volume 65 within a casing 66. The load capacity of the column 60 is then very materially greater than if the hard-stratum bore had been cylindrical, i.e., even if such a cylinder were bored to the outer diameter $D_2$ of the rib-grooves. Furthermore, for a hard-stratum material such as rock at 12'', the indicated substantial improvement in load-bearing capacity is achieved for bore-grooving of lesser depth than for previously described forms; for example, 2-in. deep grooving in the wall of a cylindrical bore of 30-in. diameter.

Figure 10:
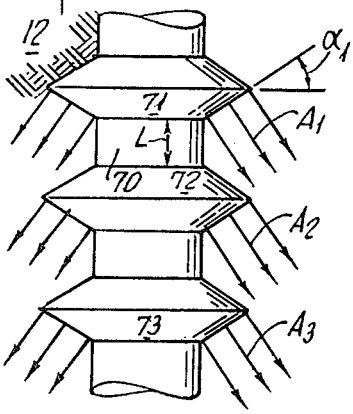
FIGS. 10 and 11 are simplified fragmentary views in elevation to explain utilization of the earth-bound medium in two variations of the invention.
Figure 11:
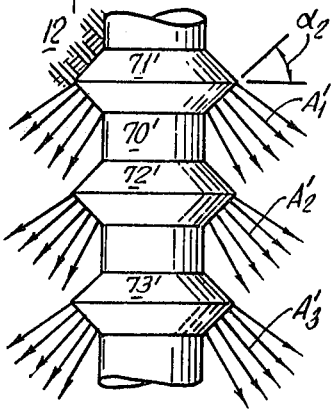

FIGS. 10 and 11 illustrate that to obtain the benefits of confined compressive strength in accordance with the invention, it does not necessarily follow that the individual circumferential rib-forming grooves need to be in contiguous adjacency. For example, in FIG. 10, wherein the slope $\alpha_1$ is relatively small for the radial extent of the frusto-conical rib surfaces, a cylindrical body portion 70, of axial extent L, may be provided between adjacent ribs 71–72 without loss of such incremental capacity of the system as may be attributable to any one rib, such as rib 71. To illustrate, plural force vectors have been drawn for the conical annulus $A_1$ beneath the load surface of rib 71, all such vectors being locally normal to said surface 71, and similar sets of force vectors have been drawn for each of the conical annuli $A_2$–$A_3$ beneath the load surfaces of adjacent lower ribs 72–73. All such annuli $A_1$–$A_2$–$A_3$ are in fully nested adjacency, so that the entire surrounding volume of the medium 12 is utilized in confined compressive stress.

FIG. 11 illustrates further that the principle of the invention is applicable even if strictly normal projection of force vectors should develop annular gaps between the conical annuli $A_1'$–$A_2'$–$A_3'$ which are normal to load surfaces of ribs 71'–72'–73'. In FIG. 11, it will be noted that the slope $\alpha_2$ is greater than for the case of $\alpha_1$ in FIG. 10, but I find that the benefits of confined compressive stress in medium 12 are still available with the structure of FIG. 11, in that the medium 12 to a degree exhibits the somewhat hydrostatic property of transversely transmitting at least some fractional component of a given normal force. Thus, the force vectors in successive conical annuli $A_1'$–$A_2'$–$A_3'$ in FIG. 11 spread or diverge both up and down with respect to a strict normal to the load-bearing frusto-conical rib surface involved. And through such spreading of force vectors, the entire surrounding volume of medium 12 becomes useful in confined compresssive stress.

The described embodiments of the invention will be seen to have achieved all stated objects. In particular, the invention will be seen to have provided a technique for increasing the capacity of caissons, piles or earth anchors by relying on the confined compressive strength of the rock or soil medium 12 adjacent the generally conical formations above and near the base of the on-side produced earthbound reference structure. This confined compressive strength is such as to effectively enlarge the sectional area of the cast structure to a diameter ($D_3$, or $D_4$) at which the medium begins to fail under the confined-compression condition. The net result is more pile, caisson or anchor effectiveness with less material and at less cost, and the improvement can be many-fold rather than a mere improvement in degree. Of course, the improvement and degree of improvement are a function of the nature of the medium 12 and of its condition, best results in soil being always obtainable for relatively undisturbed soil, i.e., in a long-settled state of the soil.

What is claimed is:

1. The method of constructing a high-capacity tension-sustaining earch-anchor reference having an axis of tension-sustaining alignment which is at angular offset from the vertical, which comprises excavating earth material to form an elongate generally cylindrical bore of a first diameter on said axis, then locally expanding the excavation to characterize a selected axial extent of the bore by local cutting to larger diametral extent at longitudinally spaced regions of the bore, each of the expanded excavations being characterized by a wall surface of relatively uniform slope with respect to the longitudinal axis of the bore and extending from said first to a second diameter, whereby the characterized bore is defined in a relatively undisturbed body of earth material, selecting a tension rod of length to span more than the characterized axial extent of the bore, said rod having one or more radially projecting formations for enhanced engagement to cementatious material, placing the rod within the bore in radially spaced relation with the bore wall and in coaxial relation with the characterized axial extent of the bore, and then casting a cementatious filling in the bore by smoothly introducing the filling into the bore, the filling being to an extent filling at least the characterized axial extent of the bore with the rod embedded to an extent short of the outer end of the rod, whereby upon curing, the cast filling is installed in a relatively undisturbed body of earth material, with an end of the rod externally exposed, thereby permitting maximum availability of the confined compressive strength of the earth material to enhance the tension-sustaining capacity of the earth-anchor.

2. The method of claim 1, in which the expanded-excavation step forms axially adjacent uniformly sloping wall surfaces in a consecutive sequence of such expanded excavations.

3. The method of claim 1, in which the expanded-excavation step forms axially adjacent uniformly sloping wall surfaces in opposite directions of slope with respect to the bore axis.

4. The method of claim 1, in which the slope of the sloping excavated wall surface is in the range of 20° to 85° with respect to a radial plane normal to the bore axis.

5. The method of claim 1, wherein the earth material consists primarily of rock, and in which the slope of the sloping excavated wall surface is in the range of substantially 20° to 50° with respect to a radial plane normal to the bore axis.

6. The method of claim 1, wherein the earth material consists primarily of soil, and in which the slope of the sloping excavated wall surface is in the range of substantially 40° to 85° with respect to a radial plane normal to the bore axis.

7. The method of claim 3, in which the adjacent oppositely sloping wall surfaces are of substantially the same magnitude of slope.

8. The method of claim 1, in which the expanded-excavation step forms axially adjacent uniformly sloping wall surfaces in a consecutive sequence at relatively short axial spacing between such adjacent expanded local excavations.

9. The method of claim 1, in which said cementatious filling is made at elevated pressure.

10. The method of claim 1, in which the one or more radially projecting formations include a radially extending plate secured to the rod at the inner end of the bore.

* * * * *